US012729929B2

(12) United States Patent
Palmer et al.

(10) Patent No.: US 12,729,929 B2
(45) Date of Patent: Sep. 8, 2026

(54) STOCK FOR A FIREARM

(71) Applicant: Caracal International, LLC, Sweihan (AE)

(72) Inventors: Andrew Palmer, Arabian Ranches (AE); Konstantin Nedev, Al Zeina (AE); Naser Ali Alomaira, Abu Dhabi (AE)

(73) Assignee: CARACAL INTERNATIONAL, LLC, Sweihan (AE)

( * ) Notice: Subject to any disclaimer, the term of this patent is extended or adjusted under 35 U.S.C. 154(b) by 0 days.

(21) Appl. No.: 18/885,533

(22) Filed: Sep. 13, 2024

(65) Prior Publication Data

US 2025/0093127 A1 Mar. 20, 2025

Related U.S. Application Data

(60) Provisional application No. 63/538,385, filed on Sep. 14, 2023.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/06; F41C 23/02; F41C 23/20; F41C 23/14; F41C 23/22
USPC ..... 42/71.1–75.1
See application file for complete search history.

(56) References Cited

U.S. PATENT DOCUMENTS 3,226,872 A * 1/1966 Pachmayr ..... F41C 23/02 42/85
3,324,588 A * 6/1967 Gilbert ..... F41C 23/00 42/71.01
6,370,806 B1 * 4/2002 Klebes ..... F41A 19/58 42/84
6,637,141 B1 * 10/2003 Weatherby ..... F41C 23/06 42/75.03
7,162,822 B1 * 1/2007 Heayn ..... F41C 23/04 42/71.01
7,640,690 B2 * 1/2010 Hines ..... F41C 23/16 42/84
7,823,313 B2 * 11/2010 Faifer ..... F41C 23/06 42/1.06
7,849,626 B2 * 12/2010 Fluhr ..... F41C 23/04 42/73

(Continued)

*Primary Examiner* — Michael D David
(74) *Attorney, Agent, or Firm* — Bennet K. Langlotz; Langlotz Patent & Trademark Works, LLC

(57) ABSTRACT

A stock for a firearm has a body defining a passage with a forward opening, the passage configured to closely receive the rearwardly extending tube, the body having a first wall portion defining a first portion of the passage and configured to conformally contact a first cylindrical portion of the rearwardly extending tube, the body having a second wall portion facing a second portion of the rearwardly extending tube and spaced apart from the second portion of the rearwardly extending tube, and a flexible support element connected to the second wall portion and extending to a position configured to contact the second portion of the rearwardly extending tube. The first wall portion may be an upper portion of the body. A lower surface of the first wall portion may be an elongated cylindrical section. The second wall portion may be below the first wall portion.

20 Claims, 6 Drawing Sheets

(56) References Cited

U.S. PATENT DOCUMENTS

| | | | | |
|---|---|---|---|---|
| 8,191,299 | B2 * | 6/2012 | Faifer | F41C 23/06 42/71.01 |
| 8,341,867 | B2 * | 1/2013 | Criswell | F41C 23/14 42/73 |
| 8,555,541 | B2 * | 10/2013 | Ingram | F41A 11/00 42/74 |
| 8,656,622 | B2 * | 2/2014 | Peterson | F41C 23/14 42/75.03 |
| 8,677,669 | B1 * | 3/2014 | Vesligaj | F41C 23/12 42/75.01 |
| 8,950,099 | B2 * | 2/2015 | Rogers | F41C 23/04 42/71.01 |
| 9,109,855 | B1 | 8/2015 | Kincel | |
| 9,429,387 | B1 * | 8/2016 | Barfoot | F41C 23/20 |
| 9,784,526 | B2 | 10/2017 | Chow et al. | |
| 10,260,837 | B1 * | 4/2019 | McGinty | F41A 3/84 |
| 12,173,984 | B2 * | 12/2024 | Swistak | F41C 23/20 |
| 12,352,528 | B2 * | 7/2025 | Roberts | F41C 23/20 |
| 2010/0115817 | A1 * | 5/2010 | Faifer | F41C 23/04 42/71.01 |
| 2012/0186122 | A1 * | 7/2012 | Zamlinsky | F41A 19/10 42/71.01 |
| 2012/0272819 | A1 * | 11/2012 | Cottle | F41A 19/00 42/71.01 |
| 2014/0109452 | A1 * | 4/2014 | Baker | F41C 23/06 42/1.06 |
| 2016/0084612 | A1 * | 3/2016 | Robinson | F41C 23/14 42/73 |
| 2016/0282084 | A1 * | 9/2016 | Hollis | F41C 33/001 |
| 2025/0093127 | A1 * | 3/2025 | Palmer | F41C 23/04 |

* cited by examiner

STOCK FOR A FIREARM

CROSS-REFERENCE TO RELATED APPLICATION

This application claims the benefit of U.S. Provisional Patent Application No. 63/538,385 filed on Sep. 14, 2023, entitled "CARBINE STOCK," which is hereby incorporated by reference in its entirety for all that is taught and disclosed therein.

FIELD OF THE INVENTION

The present invention relates to firearms, and more particularly to a stock for a firearm that minimizes play between the stock and the receiver extension of the host firearm.

BACKGROUND AND SUMMARY OF THE INVENTION

For AR-style rifles fitted with a carbine-type receiver extension, there is an option to fit the rifle with an adjustable butt stock. The receiver extension dimensions are standardized across the industry, allowing many companies to make different stocks, which fit a variety of user and consumer requirements. However, in order for an aftermarket stock to fit any rifle, the stock opening must always be larger than receiver extension part. Thus, the stock opening should be larger than the maximum possible size of the receiver extension. This means the stock will always have some undesirable play or movement relative to the receiver extension, which worsens with rifles having smaller receiver extensions. The amount of play also worsens when the stock is fully extended. Any amount of play is undesirable because movement of the stock relative to the receiver extension could make the host rifle less accurate. Although various attempts to solve this issue exist, they typically rely on the use of additional parts to take up the play. This makes these approaches more complex and expensive to manufacture and use.

Therefore, a need exists for a new and improved stock for a firearm that minimizes play between the stock and the receiver extension of the host firearm. In this regard, the various embodiments of the present invention substantially fulfill at least some of these needs. In this respect, the stock for a firearm according to the present invention substantially departs from the conventional concepts and designs of the prior art, and in doing so provides an apparatus primarily developed for the purpose of minimizing play between the stock and the receiver extension of the host firearm.

The present invention provides an improved stock for a firearm, and overcomes the above-mentioned disadvantages and drawbacks of the prior art. As such, the general purpose of the present invention, which will be described subsequently in greater detail, is to provide an improved stock for a firearm that has all the advantages of the prior art mentioned above.

To attain this, the preferred embodiment of the present invention essentially comprises a body defining a passage with a forward opening, the passage configured to closely receive the rearwardly extending tube, the body having a first wall portion defining a first portion of the passage and configured to conformally contact a first cylindrical portion of the rearwardly extending tube, the body having a second wall portion facing a second portion of the rearwardly extending tube and spaced apart from the second portion of the rearwardly extending tube, and a flexible support element connected to the second wall portion and extending to a position configured to contact the second portion of the rearwardly extending tube. The first wall portion may be an upper portion of the body. A lower surface of the first wall portion may be an elongated cylindrical section. The second wall portion may be below the first wall portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
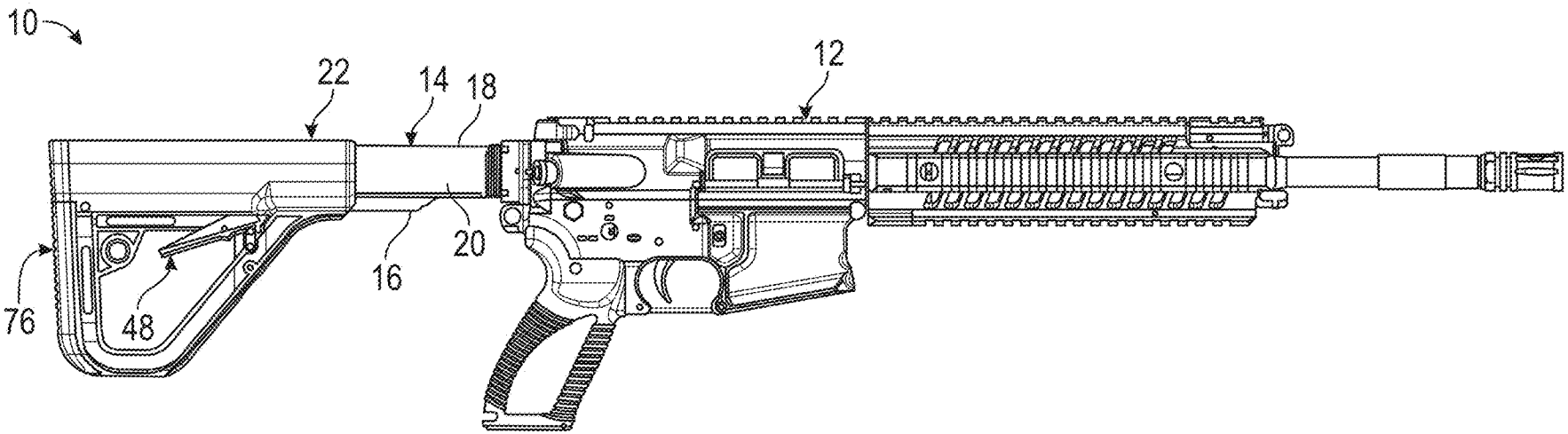
FIG. 1 is a right side view of the current embodiment of a stock for a firearm constructed in accordance with the principles of the present invention in use attached to a rearwardly extending tube of a rifle with the stock in the extended position.

An embodiment of the stock for a firearm of the present invention is shown and generally designated by the reference numeral 10.

FIG. 1 illustrates the improved stock for a firearm 10 of the present invention. More particularly, FIG. 1 shows the stock for a firearm in use attached to a rifle 12. The rifle has a rearwardly extending tube 14 that includes a lower spline portion 16. The rearwardly extending tube includes a first cylindrical portion 18 and a second portion 20.

Figure 2:
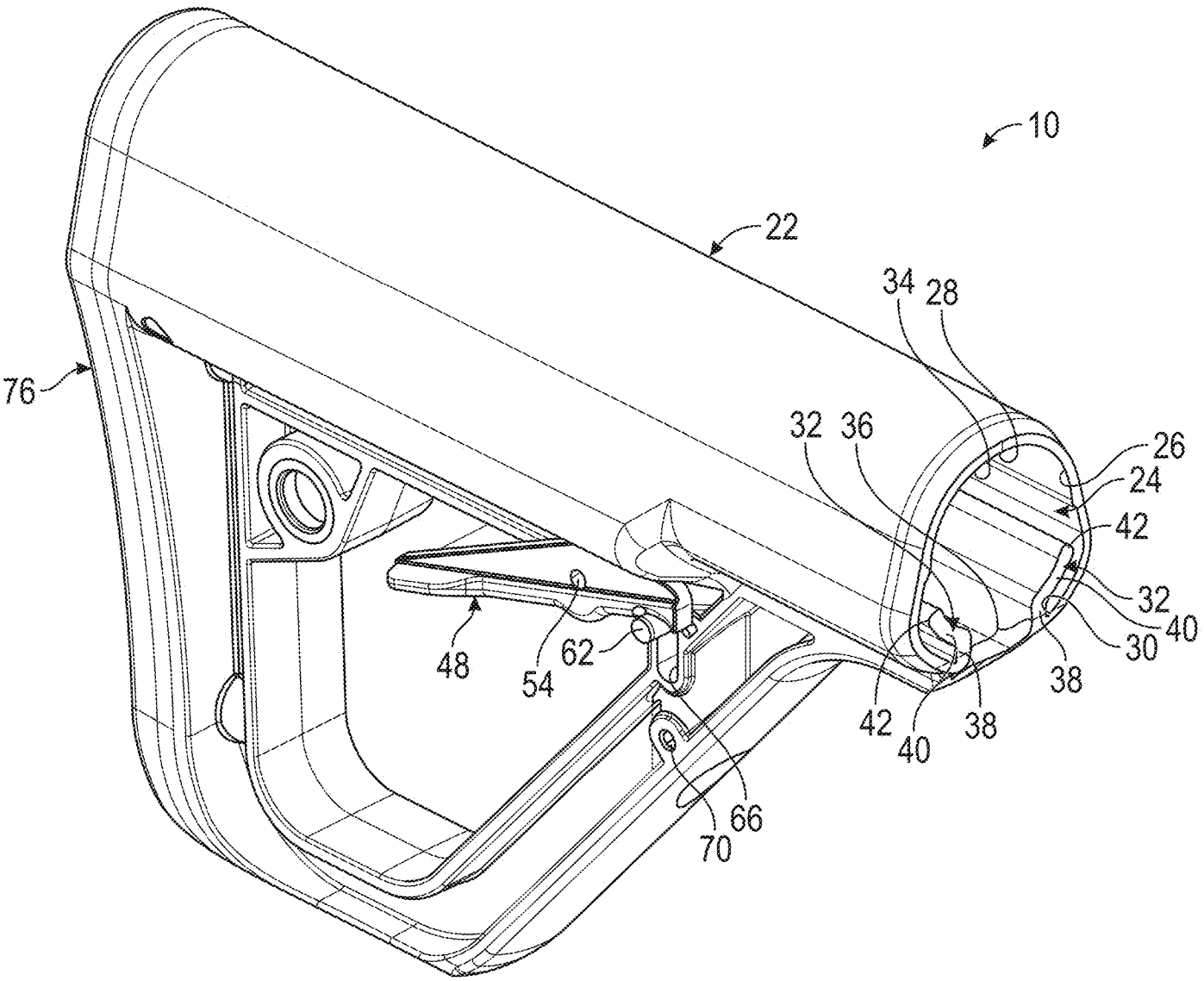
FIG. 2 is a top isometric view of the stock for a firearm of FIG. 1 detached from the rearwardly extending tube of the rifle.
Figure 3:
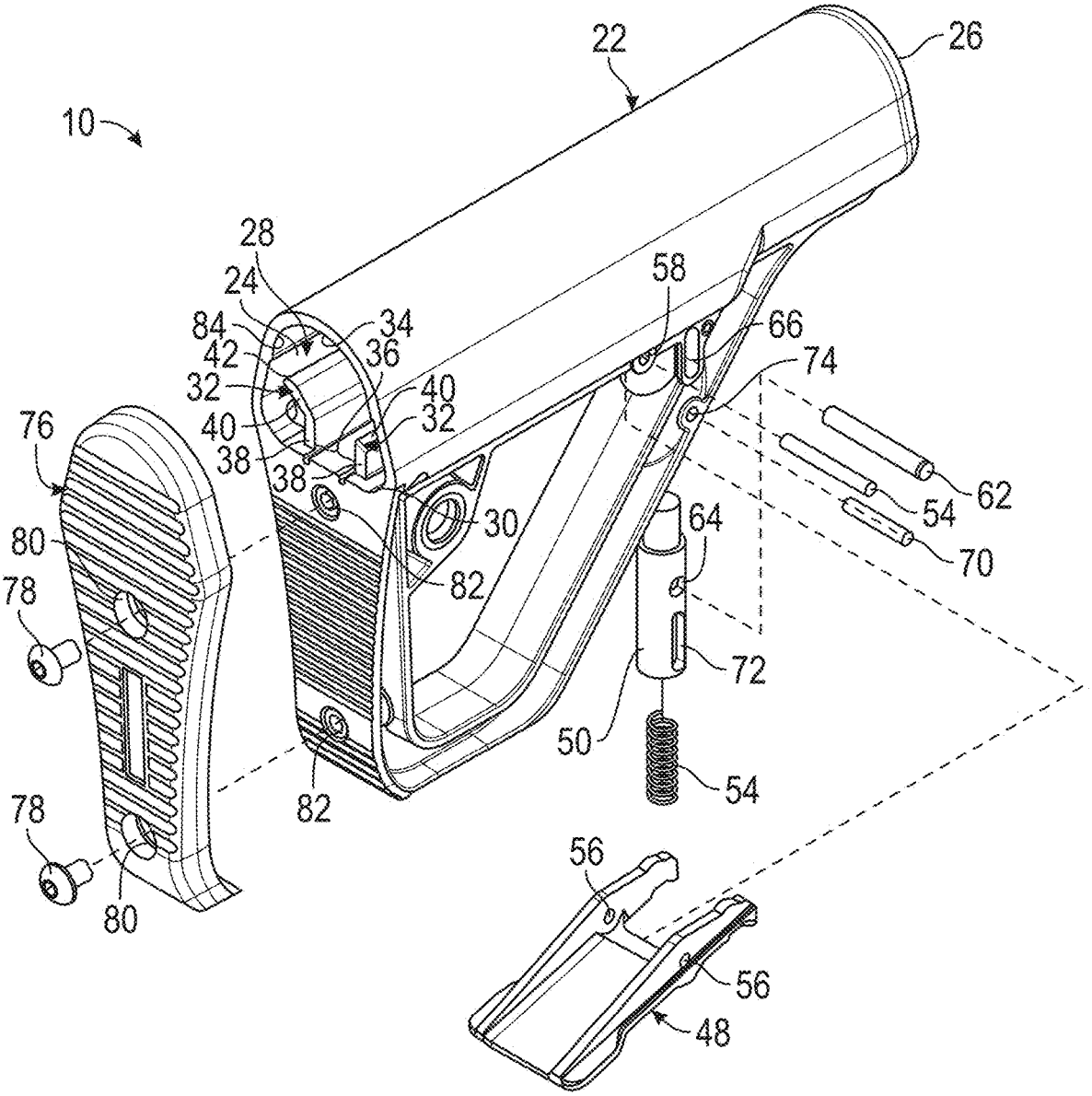
FIG. 3 is an exploded view of the stock for a firearm of FIG. 1 detached from the rearwardly extending tube of the rifle.
Figure 4:
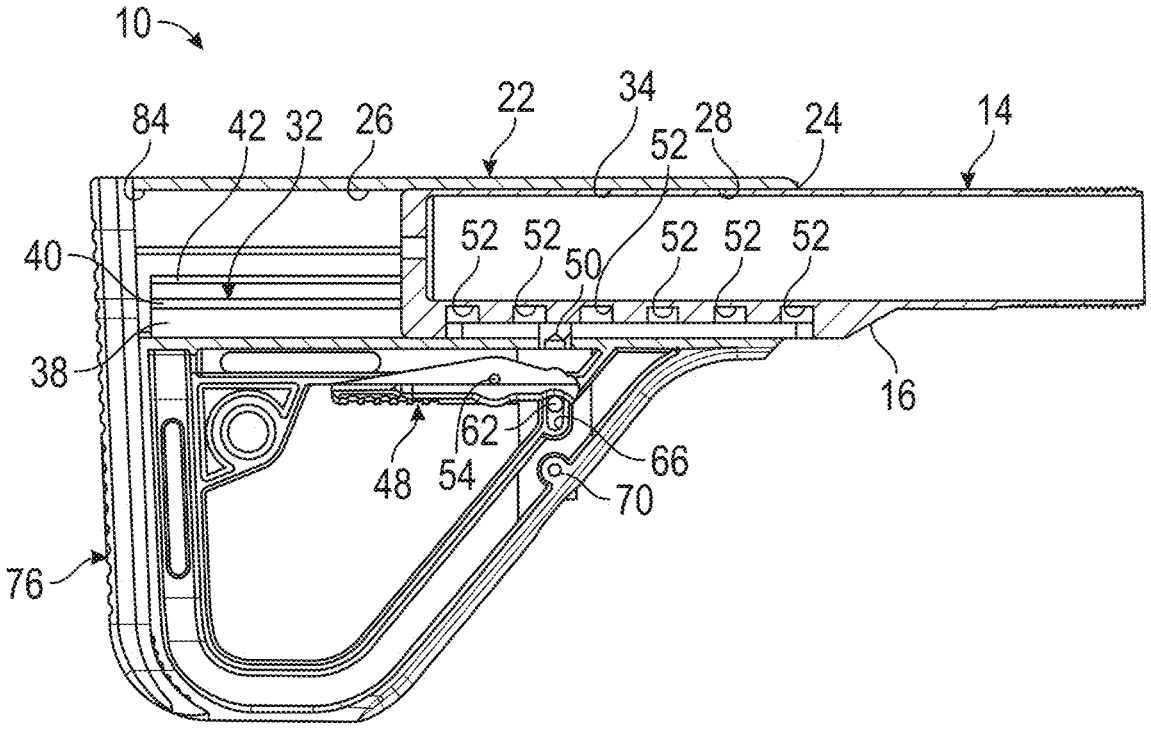
FIG. 4 is a right side sectional view of the stock for a firearm of FIG. 1 attached to the rearwardly extending tube of the rifle.
Figure 5:
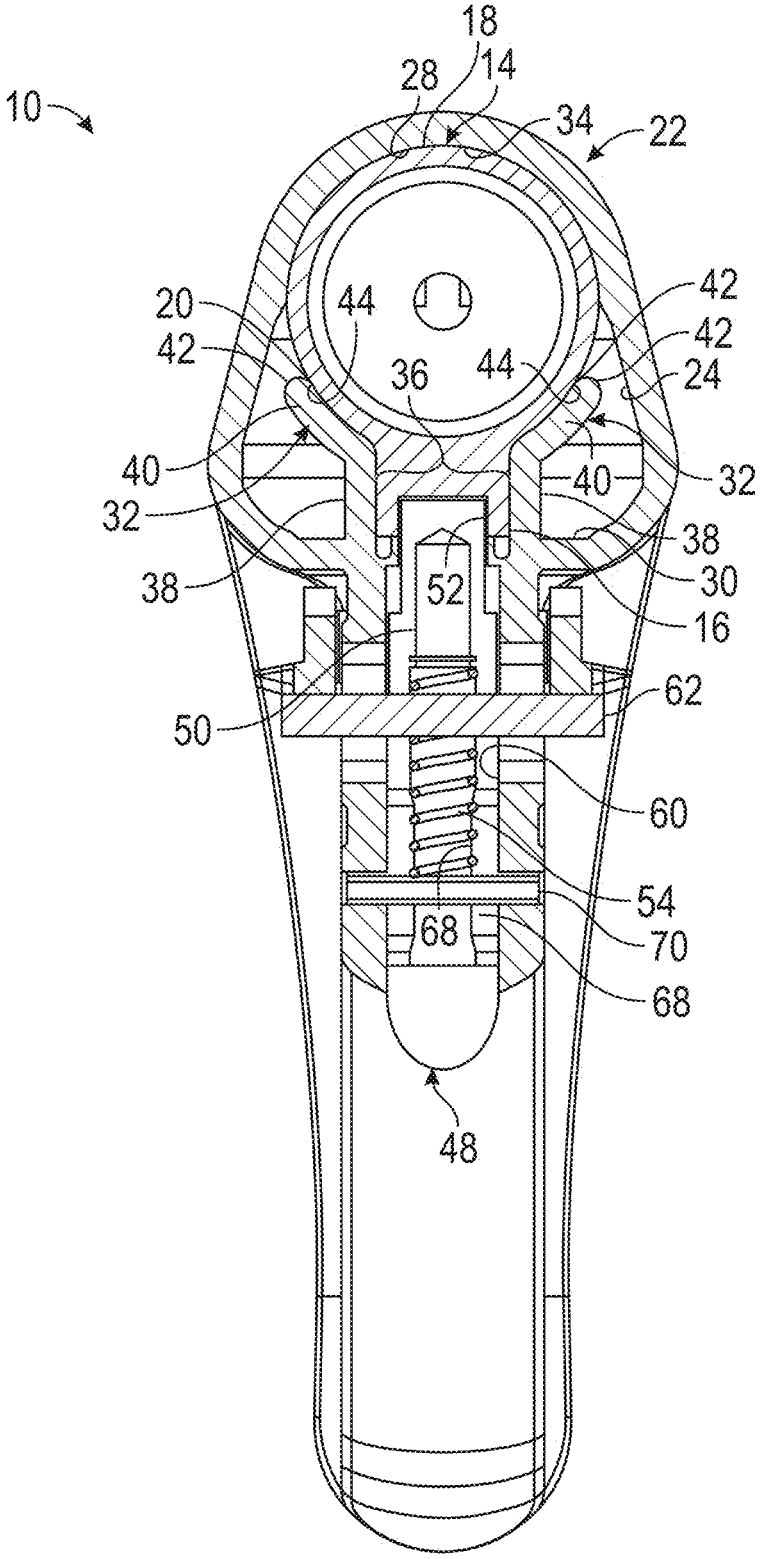
FIG. 5 is a front sectional view of the stock for a firearm of FIG. 1 attached to the rearwardly extending tube of the rifle.
Figure 6:
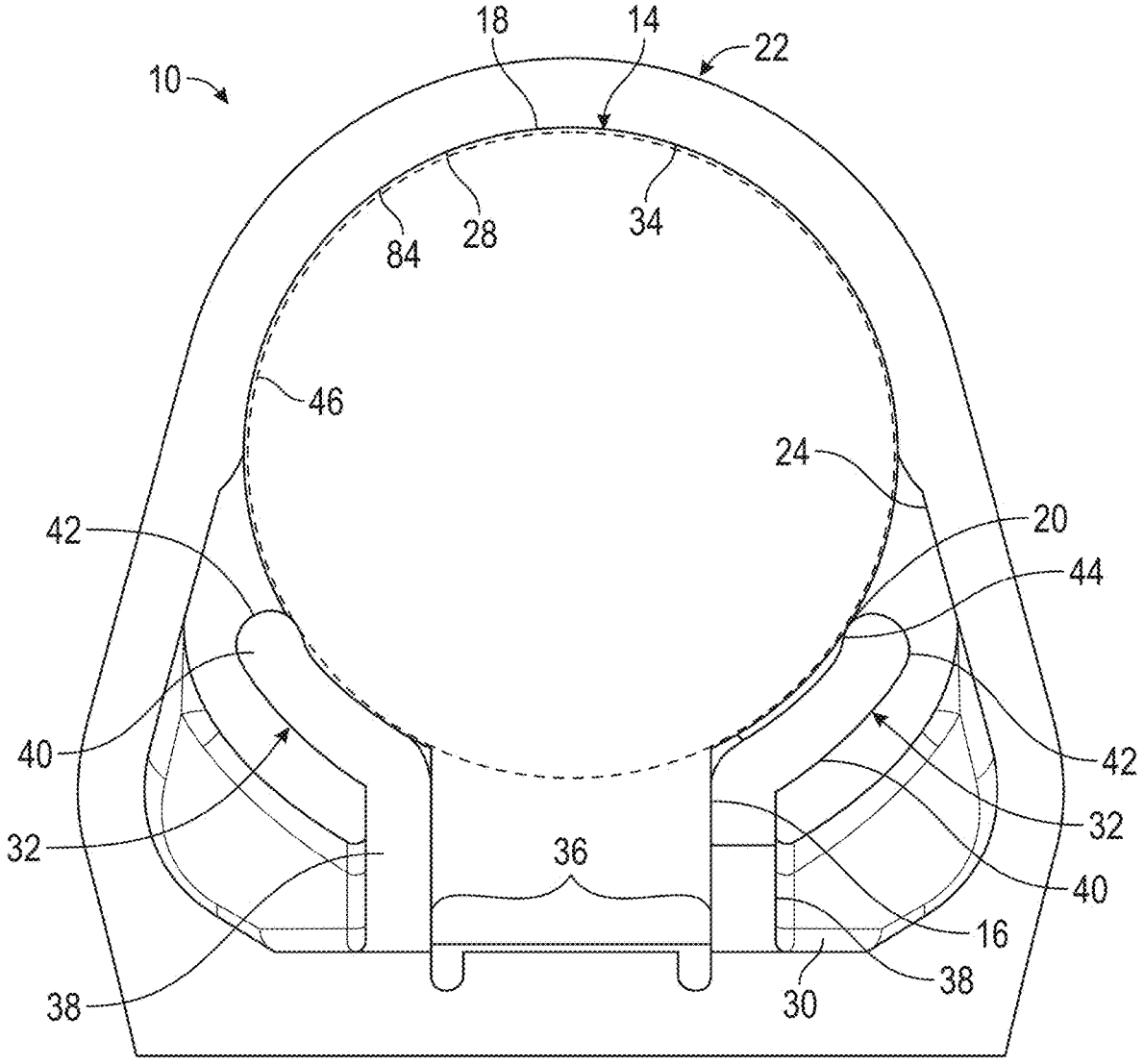
FIG. 6 is a rear view of the stock for a firearm of FIG. 1 attached to the rearwardly extending tube of the rifle.

FIGS. 2-6 illustrate the improved stock for a firearm 10 of the present invention. More particularly, FIGS. 2 & 3 illustrate the stock for a firearm detached from the rearwardly extending tube 14 of the rifle 12, and FIGS. 4-6 illustrate the stock for a firearm attached to the rearwardly extending tube of the rifle. The stock for a firearm 10 has a body 22 defining a passage 24 with a forward opening 26 and a rear opening 84. The passage is configured to closely receive the rearwardly extending tube 14 in the current embodiment. The body has a first wall portion 28 defining a first portion of the passage and configured to conformally contact the first cylindrical portion 18 of the rearwardly extending tube. The body has a second wall portion 30 facing the second portion 20 of the rearwardly extending tube and spaced apart from the second portion of the rearwardly extending tube. A flexible support element 32 is connected to the second wall portion and extends to a position configured to contact the second portion of the rearwardly extending tube. The body can be formed as a unitary body, including being a single molded plastic form in the current embodiment.

In the current embodiment, the first wall portion 28 is an upper portion of the body 22. A lower surface 34 of the first wall portion is an elongated cylindrical section. The second wall portion 30 is below the first wall portion. The flexible support element 32 is an elongated element extending along the length of the passage 24. The flexible support element has an articulated cross-sectional profile. There are a pair of flexible support elements in the current embodiment that are spaced apart to define a channel 36. The channel has a straight profile configured to closely receive the lower spline portion 16 of the rearwardly extending tube 14, such that rotation of the stock for a firearm 10 relative to the rearwardly extending tube is prevented.

The flexible support element 32 includes a first portion 38 extending from the second wall portion 30 to the rearwardly extending tube 14, and a second cylindrical portion 40 connected to the first portion and having a cylindrical surface 42 configured to contact a selected cylindrical portion 44 of the rearwardly extending tube.

It should be appreciated that the pair of flexible support elements 32 grip the lower spline portion 16 of the rearwardly extending tube 14 with loose tolerances and curve around the second portion 20 of the rearwardly extending tube. The flexible support elements ensure the rearwardly extending tube is pushed tightly into the passage 24 of the body 22, reducing any play between the two parts. The flexible support elements are sized and positioned to ensure they will always have at least a slight interference with even the smallest rearwardly extending tube (indicated by the dashed circle 46 in FIG. 6) so the flexible support elements are forced apart for a tight fit. The flexible support elements are sufficiently flexible to accommodate even the largest rearwardly extending tube by displacing further.

The stock for a firearm 10 includes a pull adjustment lever 48, which can be depressed to retract a locking plunger 50 from a selected aperture 52 defined by the lower spline portion 16 of the rearwardly extending tube 14. While the pull adjustment lever is depressed, the body 22 can be moved forward or rearward along the rearwardly extending tube to adjust the length of pull. The pull adjustment lever is released to engage the locking plunger with a selected aperture once the desired length of pull adjustment has been achieved. A spring 54 biases the locking plunger into a locked position where the locking plunger is engaged with a selected aperture.

The pull adjustment lever 48 is pivotally attached to the body 22 by a pin 54 received in apertures 56 defined by the pull adjustment lever and aperture 58 defined by the body. The locking plunger 50 is retained within a passage 60 defined by the body by a pin 62 received by an aperture 64 defined by the locking plunger and a slot 66 defined by the body. The spring 54 is retained within a passage 68 defined by the locking plunger by a pin 70 received by a slot 72 defined by the locking plunger and an aperture 74 defined by the body. The slots 66 and 72 enable the locking plunger to move vertically within the passage defined by the body under the influence of the pull adjustment lever 48 and the spring.

An optional butt pad 76 is removably attached to the body 22 by two screws 78. The two screws are received by two apertures 80 defined by the butt pad and are threadedly received by two threaded apertures 82 defined by the body. The butt pad helps to absorb the shock of recoil when the rifle 12 is discharged. The butt pad also closes off the rear opening 84 of the passage 24 defined by the body. However, the stock is still functional without the butt pad fitted.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a stock for a firearm has been described in detail, it should be apparent that modifications and variations thereto are possible, all of which fall within the true spirit and scope of the invention. For example, although use with an AR-style rifle or carbine has been disclosed, the stock for a firearm can be used with many other weapon systems that include a similar interface. This can be done in two ways, the first being where the same parts are used (the parts may or may not also house the spring and buffer). The second way is where the interface is only used (the outside profile and indexing holes are used only) where the internal parts and the interface onto the firearm can vary. Furthermore, although manufacturing of the stock for a firearm as a one piece molding has been disclosed, other versions could made in multiple pieces. For example, the stock body itself could be made in two or more pieces so that battery storage, cheek rests, or other elements can be attached to the stock body using methods such as screws, rivets, or clips. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A stock for a firearm having a rearwardly extending tube, the stock comprising:

a body defining a passage with a forward opening;

the passage configured to closely receive the rearwardly extending tube;

the body having a first wall portion defining a first portion of the passage and configured to conformally contact a first cylindrical portion of the rearwardly extending tube;

the body having a second wall portion facing a second portion of the rearwardly extending tube and spaced apart from the second portion of the rearwardly extending tube;

a flexible support element connected to the second wall portion and extending to a position configured to contact the second portion of the rearwardly extending tube; and the flexible support element being entirely contained within the passage.

2. The stock of claim 1 wherein the first wall portion is an upper portion of the body.

3. The stock of claim 1 wherein a lower surface of the first wall portion is an elongated cylindrical section.

4. The stock of claim 1 wherein the second wall portion is below the first wall portion.

5. The stock of claim 1 wherein the flexible support element is an elongated element extending along the length of the passage.

6. The stock of claim 1 wherein the flexible support element has an articulated cross-sectional profile.

7. The stock of claim 1 including a pair of flexible support elements.

8. The stock of claim 7 wherein the flexible support elements are spaced apart to define a channel.

9. The stock of claim 8 wherein the channel has a straight profile configured to closely receive a lower spline portion of the rearwardly extending tube, such that rotation of the stock relative to the rearwardly extending tube is prevented.

10. The stock of claim 1 wherein the flexible support element includes a first portion extending from the second wall portion to the rearwardly extending tube, and a second cylindrical portion connected to the first portion and having a cylindrical surface configured to contact a selected cylindrical portion of the rearwardly extending tube.

11. The stock of claim 1 wherein the body is formed as a unitary body.

12. The stock of claim 1 wherein the body is a single molded plastic form.

13. A stock for a firearm having a rearwardly extending tube, the stock comprising:

a body defining a passage with a forward opening;

the passage configured to closely receive the rearwardly extending tube;

the body having a first wall portion defining a first portion of the passage and configured to conformally contact a first cylindrical portion of the rearwardly extending tube;

the body having a second wall portion facing a second portion of the rearwardly extending tube and spaced apart from the second portion of the rearwardly extending tube;

a flexible support element connected to the second wall portion and extending to a position configured to contact the second portion of the rearwardly extending tube;

the flexible support element being entirely contained within the passage; and wherein the flexible support element is an elongated element extending along the length of the passage.

14. The stock of claim 13 wherein the first wall portion is an upper portion of the body.

15. The stock of claim 13 wherein a lower surface of the first wall portion is an elongated cylindrical section.

16. The stock of claim 13 wherein the second wall portion is below the first wall portion.

17. The stock of claim 13 wherein the flexible support element has an articulated cross-sectional profile.

18. The stock of claim 13 including a pair of flexible support elements.

19. The stock of claim 13 wherein the flexible support element includes a first portion extending from the second wall portion to the rearwardly extending tube, and a second cylindrical portion connected to the first portion and having a cylindrical surface configured to contact a selected cylindrical portion of the rearwardly extending tube.

20. The stock of claim 13 wherein the body is formed as a unitary body.

* * * * *